US009593579B2

(12) United States Patent
Li et al.

(10) Patent No.: US 9,593,579 B2
(45) Date of Patent: Mar. 14, 2017

(54) CRANK CIRCULAR SLIDING BLOCK MECHANISM AND RECIPROCATING MEMBER, CYLINDER BLOCK, INTERNAL COMBUSTION ENGINE, AND COMPRESSOR

(75) Inventors: Ming Li, Beijing (CN); Zhengzhong Li, Beijing (CN); Yusheng Ma, Beijing (CN); Qingxu Wang, Beijing (CN); Lijun Guo, Beijing (CN)

(73) Assignee: Beijing Sinocep Engine Technology Co., Ltd., Beijing (CN)

( * ) Notice: Subject to any disclaimer, the term of this patent is extended or adjusted under 35 U.S.C. 154(b) by 468 days.

(21) Appl. No.: 13/991,557

(22) PCT Filed: Dec. 6, 2011

(86) PCT No.: PCT/CN2011/002038
§ 371 (c)(1),
(2), (4) Date: Jul. 5, 2013

(87) PCT Pub. No.: WO2012/075680
PCT Pub. Date: Jun. 14, 2012

(65) Prior Publication Data

US 2014/0116245 A1 May 1, 2014

(30) Foreign Application Priority Data

Dec. 6, 2010 (CN) ..... 2010 1 0581937
Dec. 6, 2010 (CN) ..... 2010 1 0581946
(Continued)

(51) Int. Cl.
*F01B 1/06* (2006.01)
*F01B 9/02* (2006.01)
(Continued)

(52) U.S. Cl.
CPC ..... *F01B 1/06* (2013.01); *F01B 9/026* (2013.01); *F02B 75/32* (2013.01); *F02B 2075/1812* (2013.01)

(58) Field of Classification Search
CPC ..... F01B 9/026; F01B 13/068; F02B 75/32; F02B 2075/1812; F02B 9/02; F04B 27/053; F02F 1/004
(Continued)

(56) References Cited

U.S. PATENT DOCUMENTS 3,329,134 A * 7/1967 Llewellyn ..... F01B 9/026 123/197.2
3,648,671 A * 3/1972 Llwellyn ..... F01B 1/062 123/55.7
(Continued)

FOREIGN PATENT DOCUMENTS

CN 85100358 8/1986
CN 1144879 3/1997
(Continued)

OTHER PUBLICATIONS

International Search Report mailed Mar. 13, 2012 in PCT Application No. PCT/CN2011/002038, 3 pages.
(Continued)

*Primary Examiner* — F. Daniel Lopez
*Assistant Examiner* — Richard Drake
(74) *Attorney, Agent, or Firm* — Kilpatrick Townsend & Stockton LLP

(57) ABSTRACT

A crank circular slider mechanism that includes a multi-row reciprocating motion part and a one-row reciprocating part. The multi-row reciprocating motion part has a guiding part divided by a longitudinal groove into two rows parallel to each other, each of which has a hole for a circular slider. The one-row reciprocating motion part has a guiding part which
(Continued)

can be inserted into the longitudinal groove of the multi-row reciprocating motion part along the thickness direction, so as to vertically traverse the multi-row reciprocating motion part. The guiding part of the one-row reciprocating motion part includes a hole receiving a middle circular slider. Two circular sliders are mounted in the same phase; the middle circular slider is sandwiched therebetween and is located with a 180 degree phase difference compared to them. Adjacent circular sliders are secured to each other.

15 Claims, 12 Drawing Sheets

(30) Foreign Application Priority Data

| | | |
|---|---|---|
| Dec. 6, 2010 | (CN) | 2010 1 0581948 |
| Dec. 6, 2010 | (CN) | 2010 1 0581950 |
| Dec. 6, 2010 | (CN) | 2010 1 0581951 |
| Jul. 7, 2011 | (CN) | 2011 1 0189964 |
| Jul. 7, 2011 | (CN) | 2011 2 0238986 U |

(51) Int. Cl.
*F02B 75/32* (2006.01)
*F02B 75/18* (2006.01)

(58) Field of Classification Search
USPC ..... 92/72, 140, 165 R
See application file for complete search history.

(56) References Cited

U.S. PATENT DOCUMENTS

| | | | | |
|---|---|---|---|---|
| 4,850,313 | A | 7/1989 | Gibbons | |
| 5,782,213 | A * | 7/1998 | Pedersen | F01B 9/026 123/197.4 |
| 5,934,229 | A * | 8/1999 | Li | F01B 9/023 123/192.2 |
| 6,631,671 | B1 * | 10/2003 | Vool | F02B 75/22 74/50 |

FOREIGN PATENT DOCUMENTS

| | | |
|---|---|---|
| CN | 1144880 | 3/1997 |
| CN | 102003519 | 4/2011 |
| CN | 102086926 | 6/2011 |
| CN | 102094962 | 6/2011 |
| CN | 102094963 | 6/2011 |
| EP | 846849 | 6/1998 |
| RU | 2154178 | 8/2000 |
| RU | 2298105 | 4/2007 |
| WO | 9006426 | 6/1990 |

OTHER PUBLICATIONS

International Preliminary Report on Patentability dated Jun. 12, 2013 in International Patent Application No. PCT/CN2011/002038 with English Translation.
European Patent Application No. 11846356.1, "Supplementary European Search Report", dated Apr. 1, 2015.
Russian Application No. RU2013130986/06(046331), "Decision on Grant", dated Mar. 15, 2016 with English translation.

* cited by examiner

CRANK CIRCULAR SLIDING BLOCK MECHANISM AND RECIPROCATING MEMBER, CYLINDER BLOCK, INTERNAL COMBUSTION ENGINE, AND COMPRESSOR

PRIOR RELATED APPLICATIONS

This application is a National Phase application of International Application No. PCT/CN2011/002038 filed Dec. 6, 2011, which claims priority to Chinese Patent Application No. 201010581951.4 filed Dec. 6, 2010, Chinese Patent Application No. 201010581937.4 filed Dec. 6, 2010, Chinese Patent Application No. 201010581946.3 filed Dec. 6, 2010, Chinese Patent Application No. 201010581950.X filed Dec. 6, 2010, Chinese Patent Application No. 201010581948.2 filed Dec. 6, 2010, Chinese Patent Application No. 201120238986.8 filed Jul. 7, 2011, and Chinese Patent Application No. 201110189964.1 filed Jul. 7, 2011, each of which is incorporated herein by reference in its entirety.

TECHNICAL FIELD

The invention relates to a reciprocating-rotary motion and inter-exchangeable mechanism, in particular, a crank circular-slider mechanism. The invention also provides a part designed for the crank circular slider mechanism. The invention also provides an equipment using the crank circular slider mechanism.

BACKGROUND

A movement mechanism of a conventional engine is a crank and connecting rod mechanism. Reciprocating movement of the piston is required to be transferred to the crankshaft through the link rods connected thereto. During the motion thereof, the link rods swing to and fro with the motion of the piston so as to keep the piston to undergo a periodical lateral force varied in a high step function.

Due to the presence of link rods in the crank and connecting rod mechanism, the crank and connecting rod mechanism internal combustion engines are bulky, heavy, and of poor balance performance. To address these problems, a Chinese patent document CN85100358B discloses a "crank-circular slider reciprocating piston type internal combustion engine", characterized in that it omits the link rods and adopts the cooperation between a circular slider with an eccentric hole and specifically designed piston assembly so as to realize the conversion of the linear reciprocating motion of the piston into the rotary motion.

Based on the above mentioned patent documents, the Chinese patent document CN1067741C discloses a "crank double slider reciprocating piston type internal combustion engine" which is realized in the form of pairing of the piston and the dynamic balance slider, which respectively move along the tracks vertical to each other. The piston and the dynamic balance slider overcome the motion point each other so as to avoid the negative influence on life span of the mechanism when utilizing the gear mechanism to overcome the motion point; meanwhile the resultant force due to movements of the piston and the dynamic balance slider forms a centrifugal force directed to the center of the crank pin from the centre of the crankshaft so as to facilitate the balance in order to obtain an ideal effect of dynamic balance. The problems in the mechanism lie in that the distance L between the piston and the dynamic balance slider along the axis of the crankshaft exists so that they form a bent moment on the crankshaft so that the whole mechanism cannot balance completely.

Chinese patent document CN1144880A discloses a "crank-multi-circular slider reciprocating piston type internal combustion engine" in which the motion mechanism utilizes three-circular-slider mechanism comprising a reciprocating motion group formed of three reciprocating parts in which the reciprocating tracks of the two reciprocating motion parts on both end sides are parallel to each other; the reciprocating motion track of the middle reciprocating motion pan sandwiched between the reciprocating motion parts is vertical to the said two reciprocating motion tracks of the said two reciprocating parts on end sides; the mass of the middle reciprocating motion part is the sum of the masses of the two reciprocating parts on end sides and the mass of the circular slider mounted in the middle reciprocating motion part is the sum of the masses of the circular sliders mounted in the reciprocating motion parts on end sides. The three circular sliders are secured to each other to form a circular slider group in which the circular sliders on end sides are mounted on the same phase; the middle circular slider is mounted offsetting a 180 degree phase difference compared to the circular sliders on end sides. The eccentric hole of the above mentioned three circular sliders fits over a same one crank pin.

In the above mentioned three-circular-slider mechanism, all the reciprocating inertial force finally are combined into a rotary inertial force so as to facilitate the realization of balance by provision of a balance element. And the size of the middle reciprocating motion part is set to be just located in the middle of the two reciprocating parts on end sides so that the whole mechanism will not form a bent moment on the crankshaft, that is to say, in theory, the mechanism can accomplish a complete balance effect. However the better balance effect so relies on the middle reciprocating motion part, which makes the whole mechanism too complicated. Moreover, due to increased number of the reciprocating motion parts, the length of the crank pin is required to be increased causing the rigidity of the axis system reduced. In addition, the manufacturing cost of the machine is increased notably; the reliability can be reduced. The machine requiring a small size will not possibly utilize the above mentioned mechanism.

The crank circular slider mechanism provided in the above mentioned documents can realize interchange between reciprocating motion and rotary motion and therefore not only become a motion mechanism of the internal combustion engine for conversion from reciprocating motion to rotary motion, but be used in a compressor or a vacuumizer for conversion from rotary motion to reciprocating motion.

SUMMARY OF THE INVENTION

The invention provides a crank circular slider mechanism which can improve space arrangement of the crank circular slider mechanism so as to make it for the whole mechanism possible to realize a complete balance in a smaller space.

The invention also provides a piston for the crank circular slider mechanism and an engine block adapted for the crank circular slider mechanism.

The invention also provides an internal combustion engine and a compressor for the said crank circular slider mechanism.

The invention provides a crank circular slider mechanism comprising multi-row reciprocating motion part and one-row reciprocating part:

The multi-row reciprocating motion part has a guiding part which is divided by a longitudinal groove into two rows parallel to each other, respectively named by the first row of guiding section on which is provided a first hole receiving the circular slider; and the second row of guiding section on which is provided a second hole receiving the second circular slider. The one-row reciprocating motion part has a guiding part which can be inserted into the longitudinal groove of the multi-row reciprocating motion part along the thickness direction, so as to vertically traverse the multi-row reciprocating motion part. The guiding part is provided thereon with a hole receiving the middle circular slider. The first circular slider and the second circular slider are mounted in the same phase. The middle circular slider is sandwiched between the first circular slider and the second circular slider and is located with a 180 degree phase difference compared to the two circular sliders, the adjacent circular sliders being secured to each other.

Preferably, the multi-row reciprocating motion part is a dynamic balance slider and the one-row reciprocating motion part is a double-action piston.

Preferably, each of the multi-row reciprocating motion part and the one-row reciprocating motion part is a piston, respectively multi-row reciprocating piston and one-row piston. The pistons are single-action pistons.

Preferably, the multi-row reciprocating motion part is a dynamic balance slider and the one-row reciprocating motion part is a single-action piston.

Preferably, the multi-row reciprocating motion part is a single-action piston and the one-row reciprocating motion part is a double-action piston.

Preferably, the multi-row reciprocating motion part is a double-action piston and the one-row reciprocating motion pan is a single-action piston.

Preferably, the center line of the reciprocating motion track of the multi-row reciprocating motion part is vertical to and coplanar with the center line of the reciprocating motion track of the one-row reciprocating motion part. The above mentioned center line cross at the point which lies in the rotating axis of the crankshaft of the crank circular slider mechanism.

Preferably, the multi-row reciprocating motion part has a longitudinal groove whose length is no less than the sum of the width of the guiding part of the one-row reciprocating motion part and the course of the reciprocating motion of the multi-row reciprocating motion part.

Preferably, the mass centers of the multi-row reciprocating motion part and the one-row reciprocating motion part respectively are on their respective axis.

The invention provides the reciprocating motion part for the crank circular slider mechanism which comprises a crown part and a guiding part which is divided by a longitudinal groove into two rows parallel to each other, respectively named as a first row of guiding part and a second row of guiding part on which along their thickness direction respectively are provided through holes penetrating the guiding parts, respectively named as a first circular slider receiving hole and a second circular slider receiving hole; the first row of guiding part and the second row of guiding part are respectively provided on the both sides with guiding surface whose lateral edge cooperates with inner circumferential surface on the reciprocating motion track in which is located the reciprocating motion part which can be a piston or a dynamic balance slider.

Preferably, the reciprocating motion part is a double-action piston with a crown part on each end or a dynamic balance slider with a crown part on each end.

Preferably, the reciprocating motion part is a single-action reciprocating motion part with a crown part on only one end. The longitudinal groove opens into the bottom surface of the guiding part facing the crown part.

The invention proposes an engine block for the crank circular slider mechanism, which is provided on the body with crankshaft penetration hole whose middle axis are vertical to and across each other at one point, a passage for the multi-row reciprocating motion part, a passage for the one-row reciprocating motion part. The crankshaft penetration hole traverses the body of the engine block from the front to the back so as to penetrate the crankshaft. The passages for multi-row reciprocating action part and the one-row reciprocating motion part are used for supply a track space for the reciprocating motion of the reciprocating motion part, characterized in that, the passage of the multi-row reciprocating motion part is provided with multi-row runways which comprises two rows of runways separated by a separation groove, each of which comprises a pair of guide rails facing each other. The inner circumferential surface of the guide rail respectively the guiding surfaces on both sides of the first row of guiding part and the second guiding part as each row of runway being a reciprocating motion track. The one-row passage is provided therein with a one-row runway constituted of a pair of guide rail which is through the separation groove. The multi-row runway and the one-row runway are vertical to each other.

The invention proposes an internal combustion engine which employs the above mentioned crank circular slider mechanism.

The invention also proposes a compressor which employs the above mentioned crank circular slider mechanism.

The invention provides a crank circular slider mechanism in which the reciprocating motion part comprises a multi-row reciprocating motion part and a one-row reciprocating motion part; the multi-row reciprocating motion part has a guiding part which is divided by a longitudinal groove into two parallel rows which are respectively called as a first row of guiding part and a second row of guiding part; the first row of guiding part is provided with a first circular slider receiving hole, the second row of guiding part is provided with a second circular slider receiving hole. The one-row of reciprocating motion part has a guiding part capable of being inserted into the longitudinal groove of the multi-row reciprocating motion part along the thickness and crosses vertically the multi-row of reciprocating motion part. The guiding part is provided with a middle circular slider receiving hole; the first circular slider and the second circular slider are mounted on the same phase. The middle circular slider is sandwiched between the first circular slider and the second circular slider and is located with a phase difference of 180 degree compared to the two circular sliders. The adjacent circular sliders are secured to each other. Provided that the center axis of the multi-row reciprocating motion part and the rotary axis of the crankshaft are crossed at point A and the center axis of the one-row reciprocating motion part and the rotary axis of the crankshaft are crossed at point B, the above mentioned structure can reduce the distance between points A and B notably and decreases the bending moment on the axis of the crankshaft due to the distance.

In the preferable solution of the crank circular slider mechanism, the multi-row reciprocating motion part has a first and second row of guiding parts which have same thickness and completely same structure. The said structure makes overlap of the points A and B possible and causes the bending moment along the axis of the crankshaft nonexistent and therefore improves the balance of the whole structure notably.

The preferable solution of the invention proposes a different form of structure compared to the said mechanism, comprising an I type structure in which the multi-row reciprocating motion part is a dynamic balance slider and one-row reciprocating motion part is a double action piston; a V type structure in which the multi-row piston and one-row piston are utilized and they all are one-action piston; also comprises a structure in which the multi-row reciprocating motion part is a dynamic balance slider and the one-row reciprocating motion part is a one-action piston and a structure in which the multi-row reciprocating motion part is a one-action piston and the one-row reciprocating motion part is a double-action piston, as well as a structure in which the multi-row reciprocating motion part is a double-action piston, the one-row reciprocating motion part is a one-action piston. Generally, the multi-row reciprocating motion part and one-row reciprocating motion part being a piston or a dynamic balance slider may be combine in various way for different situation.

The invention also provides a reciprocating motion part for the above mentioned crank circular slider mechanism, which is a piston or a dynamic balance slider having a multi-row guiding part. The reciprocating motion part provides a proper two-row reciprocating motion part to the crank circular slider mechanism.

The invention also provides a engine block proper to the crank circular slider mechanism, the block provides multi-row runways which are vertical to each other, and a one-row runway capable of providing a proper block for the crank circular mechanism.

DETAILED DESCRIPTION OF THE BEST CARRIED OUT MODES

Figure 1:
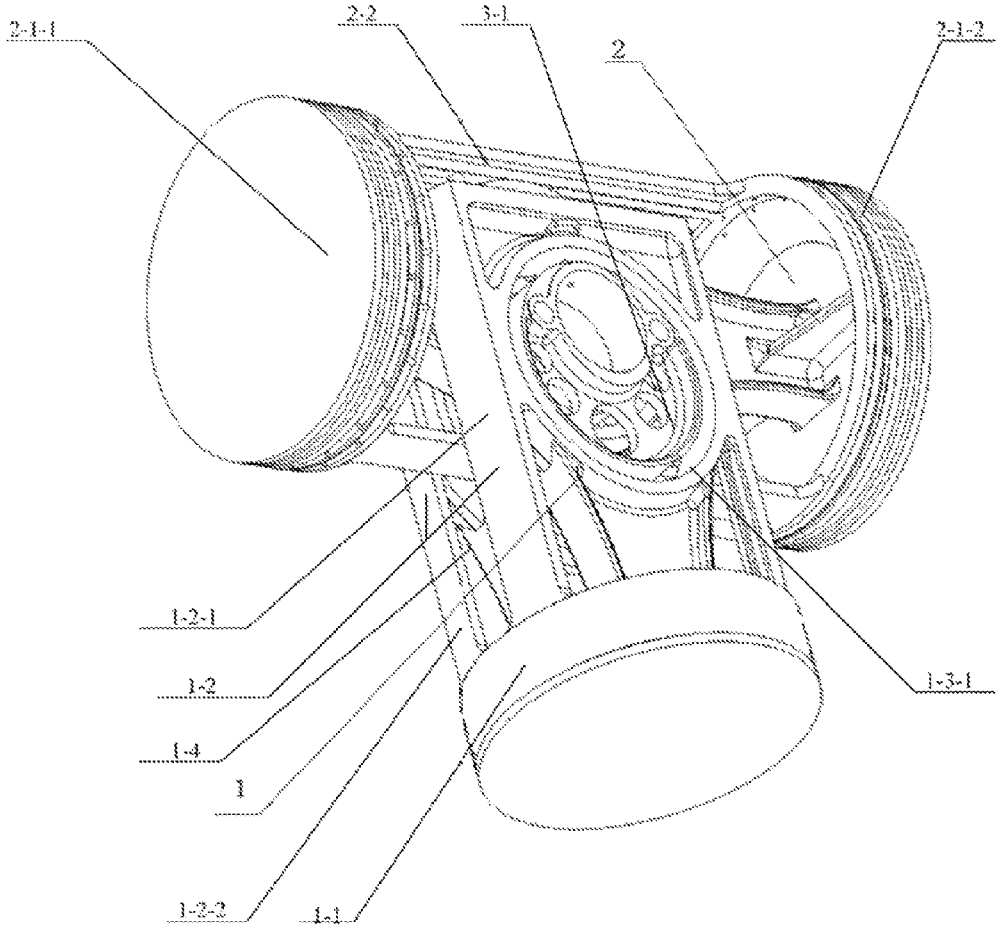
FIG. 1 is a schematic perspective of the I type of the crank circular slider mechanism proposed in the first embodiment.

Please refer to FIG. 1, which is the schematic perspective of the I type crank circular slider mechanism proposed in the first embodiment of the invention. In order to highlight the main features of the invention, the crankshaft of the crank circular slider mechanism is omitted in the view. Please also refer to FIG. 2, which is a plan cut view of the front face of the I type crank circular slider mechanism proposed in the embodiment. Please also refer to FIG. 3, which is a plan cut view of the I type crank circular slider mechanism proposed in the invention and is a left cut view of FIG. 2. Please also refer to FIG. 4 which is a front cut view of the dynamic balance slider 1.

As illustrated in the above figures, the I type crank circular slider mechanism comprises two reciprocating motion parts, respectively a dynamic balance slider 1 and a double action piston 2, which are placed respectively on the reciprocating motion tracks vertical to each other. The dynamic balance slider 1 moves up and down along the vertical direction and the double action piston 2 moves from right and left and from left and right along the horizontal direction. From FIG. 1, the guiding part 1-2 of the dynamic balance slider 1 is divided by a longitudinal groove 1-4 into two rows of branches parallel to each other, the guiding part 1-2 of the double action piston 2 traverses the longitudinal groove 1-4 in the thickness direction so as to enable the two reciprocating elements to be crossed each other. As seen in FIG. 1, the longitudinal groove 1-4 of the dynamic balance slider 1 provide the double action piston 2 with a space where it can cross the dynamic balance slider 1 so that the axis of two reciprocating elements can be crossed vertically on a plan. This is main feature of the I type crank circular slider mechanism. The following is the description of the particular structures of the I type crank circular slider mechanism.

Figure 4:
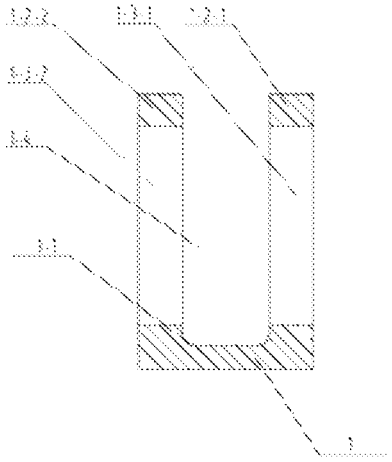
FIG. 4 is a front cut view of the dynamic slider in the I type of crank circular slider mechanism proposed in the first embodiment.

The dynamic balance slider 1 utilizes multi-row guiding part with branches, as seen in FIGS. 1 and 4. The dynamic balance slider 1 is a dynamic slider with a crown 1-1 whose guiding part 1-2 is divided by a longitudinal groove 1-4 opened into the bottom of the guiding part into two rows parallel to each other, referred to as respectively the first row of guiding part 1-2-1 and the second row of guiding part 1-2-2; the first row of guiding part 1-2-1 and the second row of guiding part 1-2-2 has the same structure, in particular the same thickness and is provided on the same position with the same circular slider receiving hole. As illustrated in figures, the first row of guiding part 1-2-1 is provided with the first circular slider receiving hole 1-3-1. The second row of guiding part is provided with the second circular slider receiving hole 1-3-2. The said first and second circular slider receiving holes are respectively designed for placing the first circular slider 3-1 and the second circular slider 3-2. The said circular sliders are the same circular sliders.

As illustrated in FIG. 1, the double action piston 2 has a first crown 2-1-1, a second crown 2-1-2 and a guiding part 2-2 connecting the said crowns. The first crown 2-1-1 and the second crown 2-1-2 have the same structures as the conventional one which is the form of cylinder with opposite inward openings used for cooperation with the air cylinder of the engine block. The crowns has a top side which is the piston top which has a upper surface used as working surface which can be a bottom surface of the combustion chamber when used as an internal combustion engine and can be a working surface of the piston when used as a compressor. Several annular grooves are provided on the outer radial surface of the cylindrical surface immediately adjacent to the piston top. These regions where the annular grooves are arranged are referred to as piston annular portions. The annular grooves are utilized for receiving air ring and oil ring and the like. The above mentioned structure are substantially same as relevant portion of the double action piston of other crank circular slider mechanism and hence are not described more detailed. The profile of the guiding part 2-2 is a rectangular solid in the middle of which is provided a middle circular slider receiving hole 2-2-1. The double action piston is mainly characterized in that its guiding part 2-2 has a thickness designed depending on the width of the longitudinal groove 1-4 of the dynamic balance slider 1 so that it can be inserted into the longitudinal groove 1-4 in the thickness direction to enable the dynamic balance slider 1 and the double action piston 2 to be crossed on the guiding part of the both. The thickness of the guiding part, particularly refers to the size which is measured by the guiding part along the axial line of the circular slider receiving hole. The width mentioned below refers to size which is measured by the guiding part vertical to the axial line of the circular slider receiving hole of the guiding part and the axial line of the piston at the same time.

The longitudinal groove 1-4 of the dynamic balance slider 1 still needs a depth of the groove enough for the dynamic balance slider 1 to reciprocate without intrusion of the double action piston 2. The groove depth is defined depending on the distance relationship of special arrangement of the two reciprocating elements so that in such circumstance as compact as possible, it is expected that the dynamic balance slider 1 moves to the lower stopping point while the lower end side of the guiding part 1-2 is in the flush with the rail side at the lower part of the guiding part 2-2 of the double action piston 2, therefore it is required that the depth of the longitudinal groove 1-4 is no less than the width of the guiding part 2-2 of the double action piston 2 plus the course of the dynamic balance slider.

Figure 2:
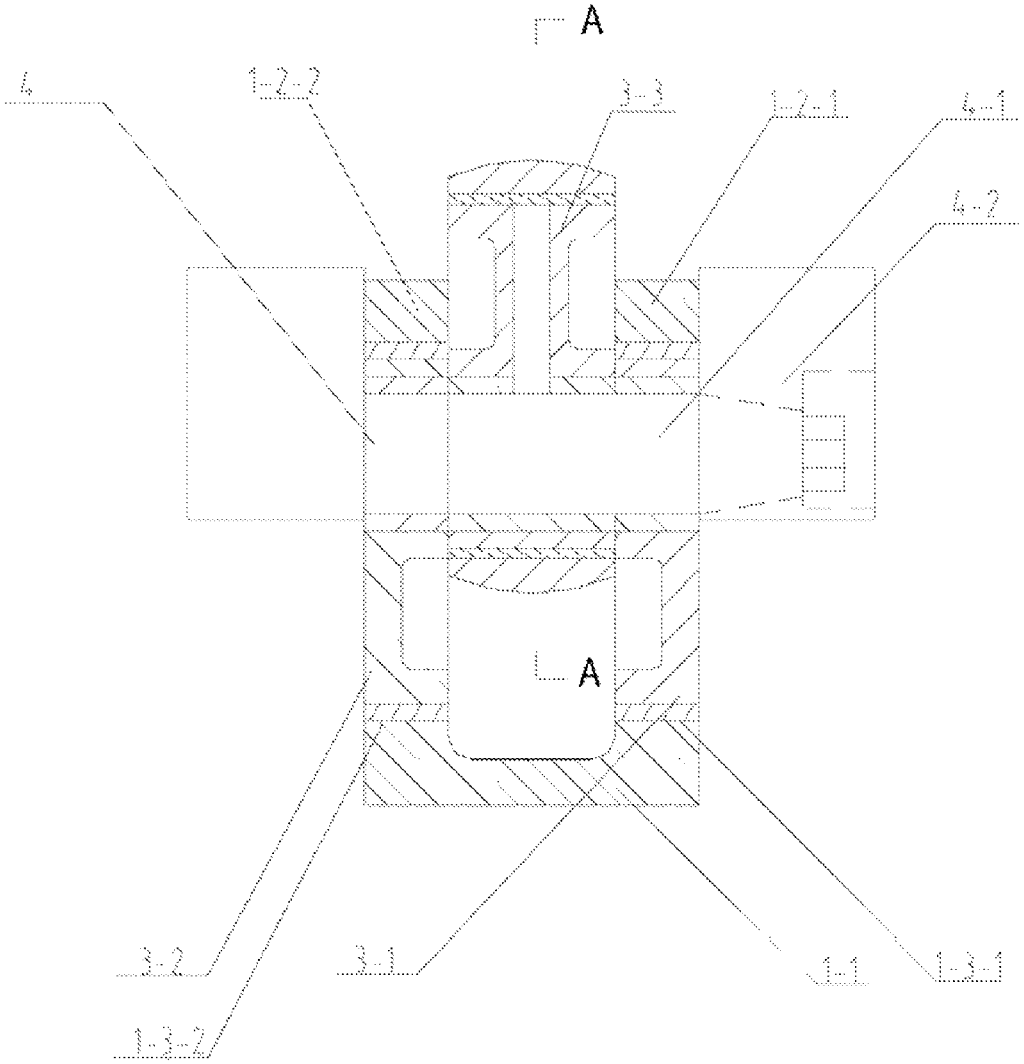
FIG. 2 is a front cut view of the I type of the crank circular slider mechanism proposed in the first embodiment.

As illustrated in FIG. 2, the dynamic balance slider 1 has a first circular slider receiving hole 1-3-1 in which the first circular slider 3-1 is arranged; a second circular slider receiving hole 1-3-2 where the second circular slider 3-2 is arranged. The holes 1-3-1 and 1-3-2 are arranged in the same phase. The double action piston 2 is provided with the middle circular slider 3-3 which is arranged in the phase opposite to the two circular sliders, that is, in the phase difference of 180 degree. The three circular sliders have eccentric holes which all fit over the crank pin of the crankshaft. The adjacent circular sliders are fixed by position pin or other structures. As illustrated in FIG. 2, the three circular sliders fit each other so as to save more space to reduce the size of the whole structure. In addition, as illustrated in FIG. 2, the first circular slider 3-1 and the second circular slider 3-2 have the thickness which is thinner than the middle circular slider 3-3. In the embodiment, the first circular slider 3-1 and the second circular slider 3-2 have the thickness which is the half of the thickness of the middle circular slider 3-3 and sum of the masses of the first circular slider 3-1 and the second circular slider are equal to the mass of the middle circular slider 3-3. In the circumstance in which the said mass relationship is not used, it is possible if the following requirements are satisfied: the circular slider group consisted of the first circular slider 3-1, the second circular slider 3-2 and the middle circular slider 3-3 has a mass center which lies on the axial line of the crank pin. The structure of the circular sliders are mentioned in the background and prior art above and hence will not be mentioned in the embodiment.

Figure 3:
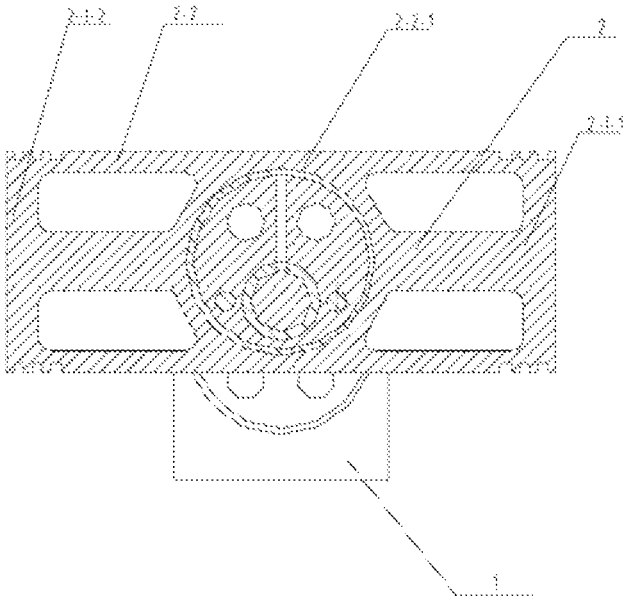
FIG. 3 is a left view cut along line A-A.

As illustrated in FIG. 2, FIG. 3, the crankshaft 4 used in the I type crank circular slider mechanism is a separate crankshaft which comprises a single throw 4-1 and a crank 4-2. The eccentric holes of the above mentioned circular sliders fit over the crank pin of the single throw 4-1.

After the above mentioned mechanism is installed in the engine block, the two crowns of the double action piston 2 are respectively arranged in the air cylinders which are arranged horizontally and oppositely in the engine block. The two air cylinders are coaxial and the common axis is the axis of the reciprocating rail of the double action piston 2; the crown 1-1 of the dynamic balance slider 1 is provided in the runway vertically arranged in the middle of the two air cylinders. Its axis is vertical to and coplanar with the common axis of the two air cylinders. The axis of the runway is the axis of the dynamic balance slider 1. The above mentioned provision causes the axis of the reciprocating rails of both of the dynamic balance slider 1 and the double action piston 2 to be coplanar and vertical and to be crossed at the point at which the axis of the two reciprocating rails intersects the rotation axis of the crankshaft 4. Since the rails of the two reciprocating motion elements has no distance along the axis of the crankshaft and no bending moment along the axis of the crankshaft so that the optimum dynamic balance effect of the whole mechanism is obtained. In order to obtain the optimum effect of the dynamic balance, it is also required that the dynamic balance slider 1 and the double action piston 2 have completely same mass and the weight centers of them lie in their respective axis.

The present embodiment is a preferable embodiment. Actually, the above mentioned relationship of the size and structure is not required strictly for the dynamic balance slider 1 with the multi-row guiding part. The relationship of the size and mass of the three circular sliders does not necessarily follow the above mentioned requirement, as long as it enables the double action piston and the dynamic balance slider crossed in the longitudinal groove 1-4 not to be intruded, the reduction of the upward bending moment of the crankshaft is produced. Moreover, in the circumstance where the size of the engine block is required loosely, the double action piston does penetrate the longitudinal groove of the multi-row dynamic balance slider not in the thickness direction, but in the width direction.

Utilization of the said structure in the internal combustion engine will result in an internal combustion engine using the crank circular slider mechanism; utilization of the said structure in the compressor will result in a compressor using the crank circular slider mechanism.

The said embodiments provide a combination of one row reciprocating element which is dual action piston and multi-row reciprocating element which is a dynamic balance slider with a single crown, and also provide a combination of other types of multi-row reciprocating element and one row reciprocating element. The following embodiments provide other combinations.

The second embodiment of the invention provides a V type crank circular slider mechanism formed by a combination of the one single action multi-row piston and the one single action one row piston.

Figure 5:
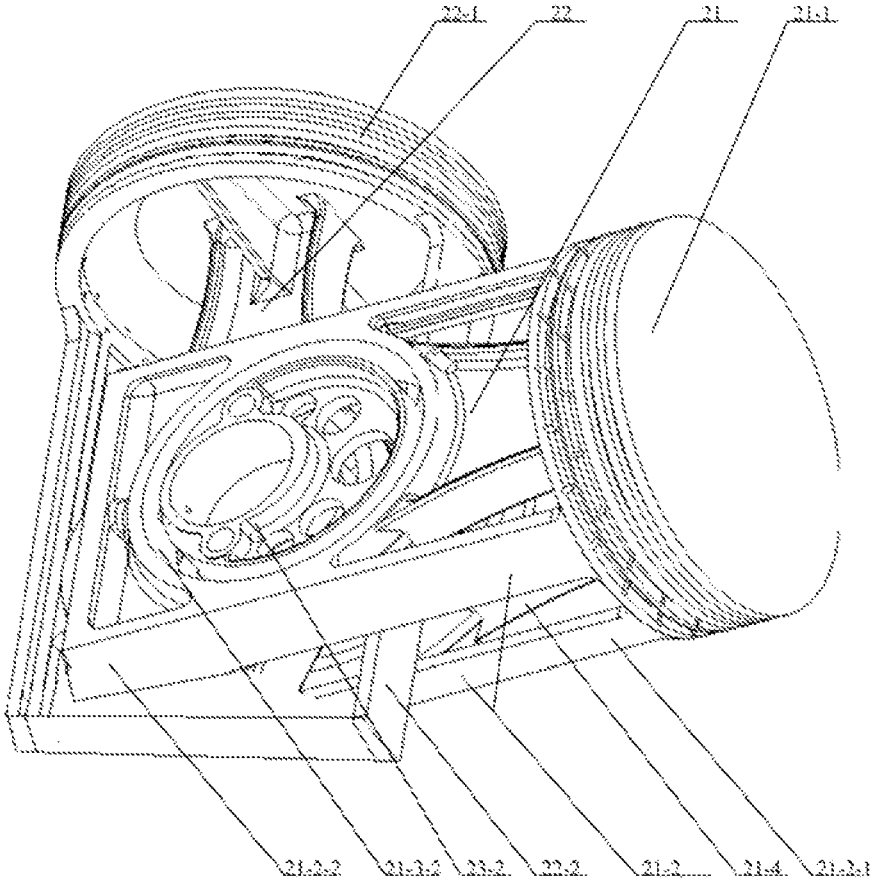
FIG. 5 is a perspective of V type of crank circular slider mechanism proposed in the second embodiment.
Figure 6:
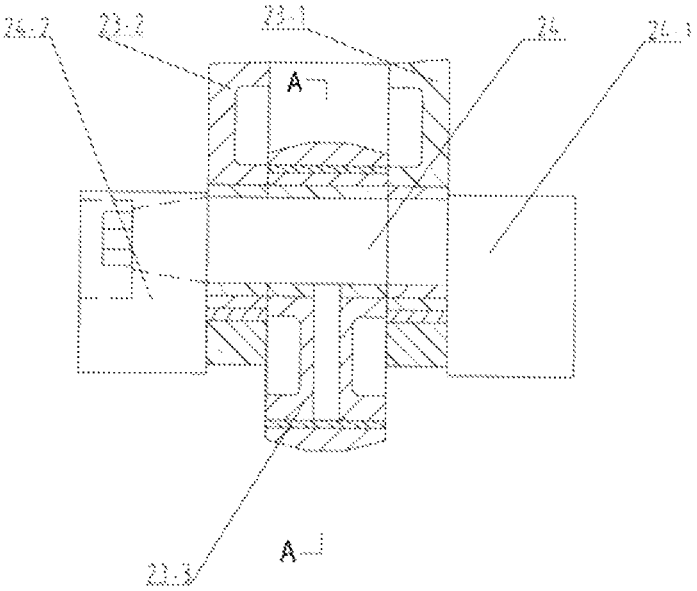
FIG. 6 is partial cut view of the V type crank circular slider mechanism at the interface of V form proposed in the second embodiment.
Figure 7:
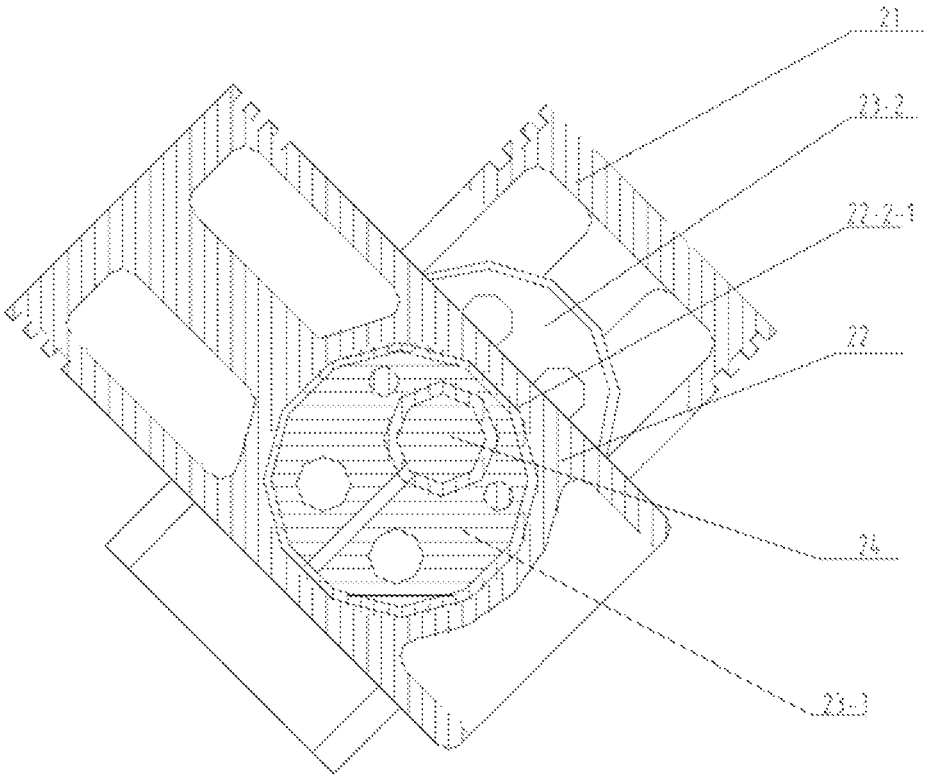
FIG. 7 is a left cut view along line A-A.

Please refer to FIG. 5, which is a perspective of V type crank circular slider mechanism in the second embodiment of the invention. In order to underline the features of the invention, the crankshaft is not shown in the perspective. As illustrated in FIG. 6, a partial cut view at the V type intersection (not showing the guiding part of the multi-row piston positioned in the outside) shows the second embodiment of the invention providing a V type crank circular slider mechanism. Please also refer to FIG. 7, which is a right view of A-A cut view of FIG. 6. Please also refer to FIG. 8 which is a cut front view of the multi-row piston 21.

As illustrated in the above figures, the V type crank circular slider mechanism comprises two reciprocating motion elements, respectively, a multi-row piston 21 and a one row piston 22, 390 which are arranged in the reciprocating rails vertical to each other and in the form of V. As seen in FIG. 5, the guiding part 21-2 of the multi-row piston 21 is divided by a longitudinal groove into two rows of parallel branches; the guiding part 22-2 of the one row piston 22 penetrates the longitudinal groove 21-4 along the thickness direction so that the two reciprocating motion elements crossed each other. As seen in FIG. 5, the longitudinal groove 21-4 of the multi-row piston 21 provides the one row piston 22 with a space crossing the multi-row piston 21 so that the two reciprocating motion elements have their axis cross vertically in a plan, which is the main feature of the V type crank circular slider mechanism.

Figure 8:
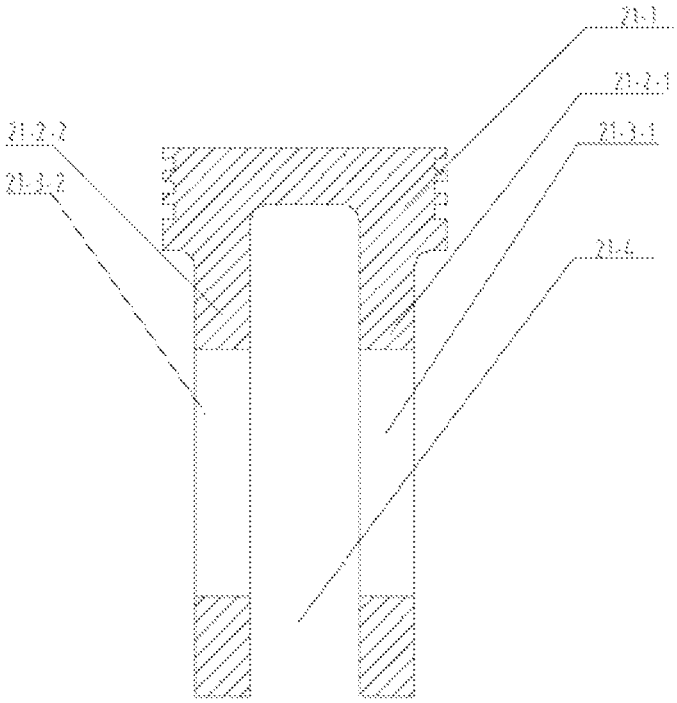
FIG. 8 is a cut view of the multi-row piston of the V type crank circular slider mechanism proposed in the second embodiment.

In the embodiment, the multi-row reciprocating motion element is a multi-row reciprocating piston 21, which adopts the multi-row guiding part structure and is a single action piston with a crown 21-1. The guiding part 21-2 of the multi-row piston 21 is divided by a longitudinal groove 21-4 whose opening is in the bottom side of the guiding part into two rows of parallel branches, respectively referred to as the first row of guiding part 21-2-1 and the second row of guiding part 21-2-2 which have the same structure and even the same thickness as well as which are provided with the same circular slider receiving hole on the same position. As illustrated in FIG. 8, the first row of guiding part 21-2-1 is provided with the first circular slider receiving hole 21-3-1 for receiving the first circular slider 23-1 and the second row of guiding part is provided with the second circular slider receiving hole 21-3-2 for receiving the second circular slider 23-2. The said two circular sliders are the sliders with same structure.

As illustrated in figures, the one row piston 22 is a one row piston with a crown 22-1 and a guiding part 22-2. The crown 22-1 has a same structure as the conventional piston and is a form of cylinder which cooperates with the air cylinder of the engine block. The outer profile of the guiding part 22-2 is a cuboid in the middle of which is provided a middle circular slider receiving hole 22-2-1. The one row piston is characterized in that the guiding part 22-2 has a thickness which is designed based on the width of the longitudinal groove 21-4 of the multi-row piston 22 so that it can be inserted into the longitudinal groove 21-4 along the thickness direction so that the multi-row piston 21 and the one row piston 22 can be crossed on their guiding part.

The multi-row piston 21 has the longitudinal groove 21-4 with a depth enough for the multi-row piston 21 to be reciprocated without intrusion of the one row piston 22. The depth is defined based on the distance of the special arrangement of the two reciprocating motion elements.

As illustrated in figures, the multi-row piston 21 has a first circular slider receiving hole 21-3-1 in which a first circular slider is arranged; a second circular slider receiving hole 21-3-2 in which the second circular slider 23-2 is arranged, they are arranged in the same way. The one row piston 22 is provided with circular slider 23-3 which arranged opposite to the above mentioned circular sliders, that is, the phase difference is 180 degree. The three circular sliders have the eccentric holes which each fit over the crank pin of the crankshaft 24 and the adjacent circular sliders are secured to each other by location pins or other similar structures. In order to produce a optimum balance effect, the first circular slider 23-1 and the second circular slider 23-2 have the thickness which is half of the thickness of the middle circular slider 23-3 and total mass of the first circular slider 23-1 and the second circular slider 23-2 is equal to the mass of the middle circular slider 23-3.

As illustrated in FIG. 6, the V type crank circular slider mechanism adopts separation type crankshaft 24, which comprises a single throw 24-1 and a crank 24-2. The eccentric holes of the circular sliders commonly fit over the crank pin of the single throw 24-1.

In order to produce the optimum balance effect, the multi-row piston 24 and the one row piston 22 should possess the same mass and their weight center should lie in their respective axis.

After the above mechanism is installed in the engine block, the two pistons respectively are installed in the air cylinders arranged in the form of V in the engine block. The air cylinders have the coplanar center axis and the two center axis are crossed at the point which is just on the rotation axis of the crankshaft 24. Due to the provision of reciprocating rails for the two pistons by the V type arranged air cylinders, the center axis of the reciprocating rails of the two pistons are intersected at one point and no distance is on the rotation axis of the crankshaft and no bending moments is on the axis of the crankshaft so that the whole mechanism possesses the optimum dynamic balance effect.

The utilization of the mechanism in the internal combustion engine results in the embodiment of the internal combustion using the crank circular slider mechanism and the utilization of the mechanism in the compressor will result in an embodiment of the compressor using the crank circular slider mechanism.

The third embodiment of the invention provides a crank circular slider mechanism for the single cylinder machine which is formed by the combination of the single action one row piston and the single crown and multi-row dynamic balance slider.

Figure 9:
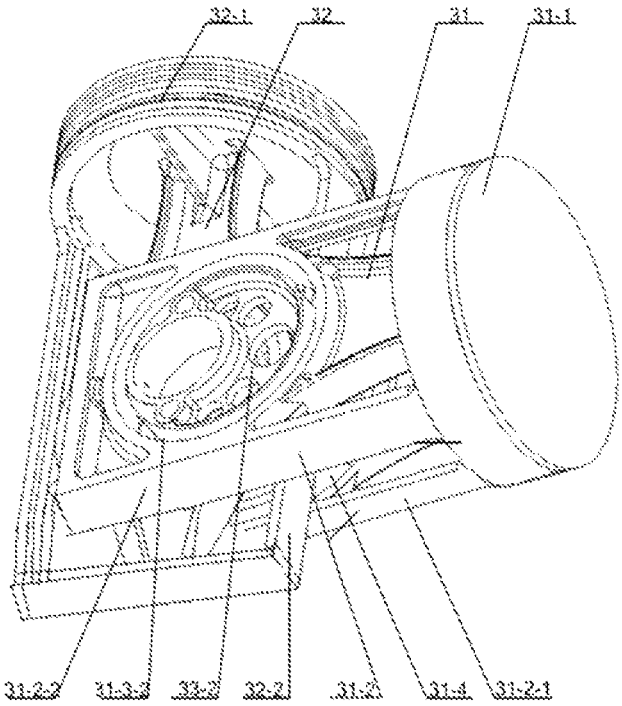
FIG. 9 is a perspective of the crank circular slider single cylinder proposed in the third embodiment.
Figure 10:
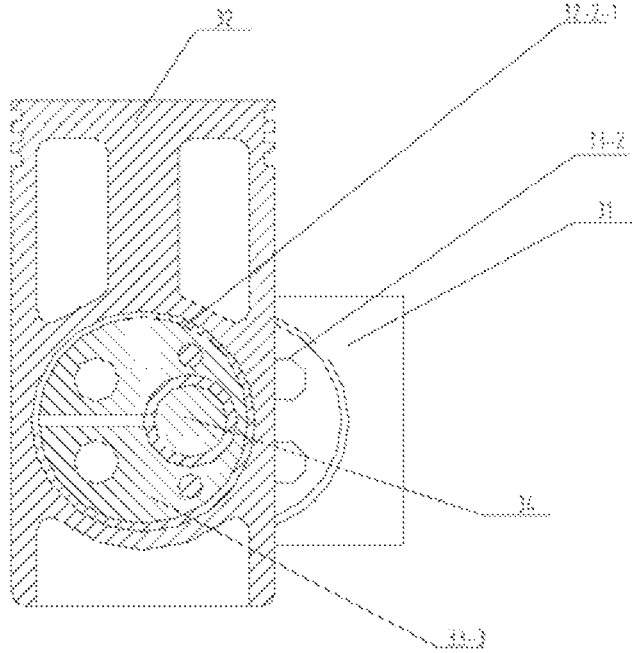
FIG. 10 is front cut view of the crank circular slider single cylinder mechanism proposed in the third embodiment of the invention, seen from one end of the crankshaft.

Please refer to FIG. 9, which is a perspective of the single cylinder mechanism of the crank circular slider provided by the third embodiment of the invention. In order to underline the features of the invention, the perspective does not show the crankshaft. Actually, the mechanism is required to be completely installed into the respective engine block so as to work. The mechanism may be utilized in the single cylinder internal combustion engine or the single cylinder compressor. Please refer to FIG. 10, which is a front cut view seen from one end of the crankshaft showing the single cylinder mechanism of the crank circular slider. Please refer to FIG. 11, which is bottom cut view of the embodiment. Please refer to FIG. 12, which is a front cut view of the multi-row dynamic balance slider 1.

As illustrated in figures, the crank circular slider mechanism comprises two reciprocating motion elements, respectively referred to as a multi-row dynamic balance slider 31 and a single action piston 32 which all are arranged on the reciprocating rails vertical to each other. As illustrated in FIG. 9, the multi-row dynamic balance slider 31 has a guiding part 32-2 which is divided by a longitudinal groove into two rows of parallel branches, the single action piston 32 has a guiding part 32-2 which penetrates the longitudinal groove 31-4 along its thickness direction so that the two reciprocating motion elements can be crossed. From FIG. 9, the multi-row dynamic balance slider 31 has a longitudinal groove 31-4 which provides the single action piston 32 with a space for its crossing the multi-row dynamic balance slider 31 so that the two reciprocating motion elements have the axis which crossed vertically in a plan, which is the main feature of the crank circular slider single cylinder mechanism.

Figure 12:
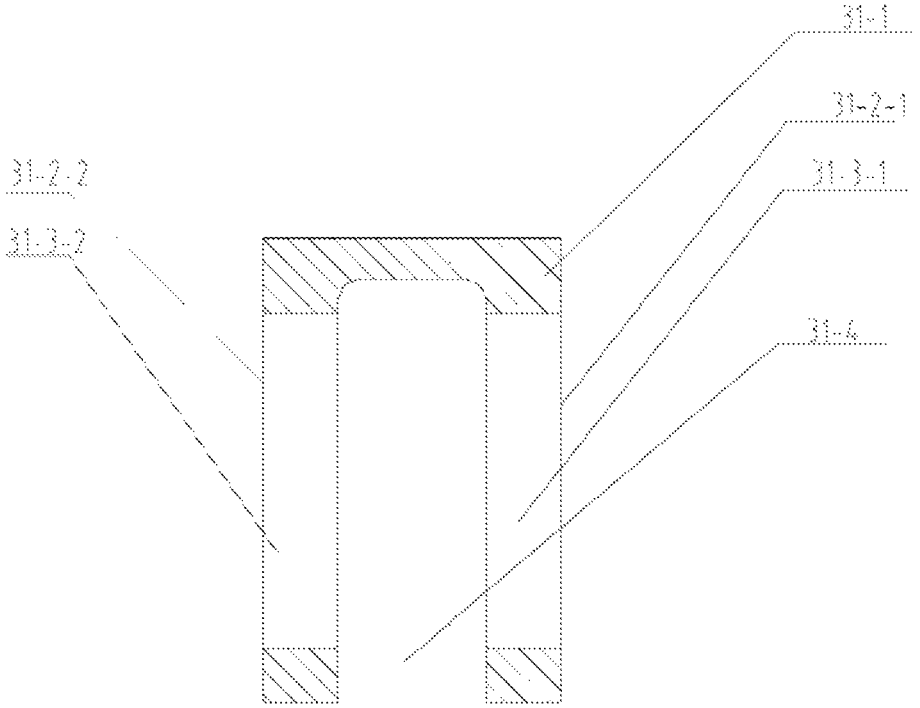
FIG. 12 is a cut view of the multi-row dynamic balance slider of the crank circular slider single cylinder mechanism proposed in the third embodiment.

The multi-row dynamic balance slider 31 uses a structure of guiding part with branches, please see the FIG. 12 for details. The multi-row dynamic balance slider 31 is a dynamic balance slider with a crown 31-1 which has the same structure as the dynamic balance slider in the conventional crank and connecting rod mechanism, in the form of cylinder or a form of bilaterally symmetrical drum. The crown 31-1 matches the sliding track in the engine block.

The multi-row dynamic slider 31 has a guiding part 31-2 which is divided by a longitudinal groove 31-4 whose opening is in the bottom side of the guiding part into two rows of parallel branches, respectively referred to as the first row of guiding part 31-2-1 and the second row of guiding part 31-2-2; they have the same structures, especially the same thickness and the same circular slider receiving hole in the same position. As illustrated in figures, the first row of guiding part 31-2-1 is provided with the first circular slider receiving hole 31-3-1 for receiving the first circular slider 33-1 and the second guiding part is provided with a second circular slider receiving hole 31-3-2 for receiving the second circular slider 33-2. They are the same circular sliders.

As illustrated in FIG. 9, the single action piston 32 has crown 32-1 and guiding part 32-2. The crown 32-1 is the same as the convention piston in terms of the structure. The guiding part 32-2 has a outer profile of cuboid and is provided with a middle circular slider receiving hole 32-2-1 (seen in FIG. 10) in its middle position. The single action piston 32 is characterized in that its guiding part 32-2 is defined in accordance with width of the longitudinal groove 31-4 of the multi-row dynamic balance slider 31 so that it can be inserted into the longitudinal groove 31-4 along the thickness direction so that the multi-row dynamic sliders 31 and the single action piston 32 can be crossed in the guiding part of the both.

The multi-row dynamic balance slider 31 has a longitudinal groove 31-4 with a depth enough for the multi-row dynamic slider 31 to be reciprocated without intrusion of the single action piston 32. The depth of the groove is determined by the distance relationship of the special arrangement for the two reciprocating motion elements. In order for the compactness in terms of structure, it is required that when the multi-row dynamic balance slider 31 moves till the lower stopping point the bottom side of its guiding part can be in flush with the guiding surface outside of the single action piston 32, therefore the depth of the longitudinal groove 31-4 should be no less than the sum of the width of the single action piston 32 and stroke of the reciprocation of the multi-row dynamic balance slider.

Figure 11:
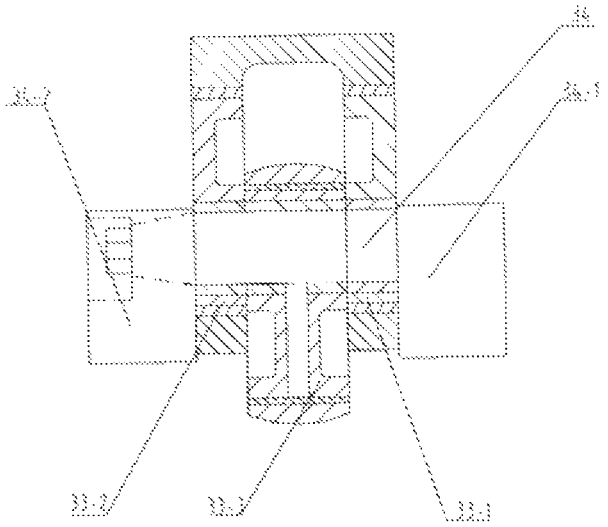
FIG. 11 is bottom cut view of the crank circular slider single cylinder of the third embodiment of the invention.

From FIG. 11, the first circular slider receiving hole 31-3-1 of the multi-row dynamic balance slider 1 receives the first circular slider 33-1; the second circular slider receiving hole 31-3-2 receives the second circular slider 33-2, they are arranged in the same phase. The middle circular slider 33-3 provided on the single action piston 32 is placed in the opposite phase to the two circular sliders, that is, a phase difference of 180 degree. The eccentric hole of the three circular slider fit over the crank pin of the crankshaft 34, and are secured to each other by location pins or the like. As seen in FIG. 11, three circular sliders are fit each other so that the space can be saved as more as possible so as to reduce the size of the whole structure. The thickness of the first circular slider 33-1 and the second circular slider 33-2 each is equal to half of the thickness of the middle circular slider 33-3 and the sum of the mass of the first circular slider 33-1 and the second circular slider 33-2 is equal to the mass of the middle circular slider 33-3.

As shown in FIG. 11, the crank circular slider single cylinder mechanism uses a separation crankshaft as the crankshaft 34 which comprises a single throw 34-1 and a crank 34-2. The eccentric holes of the circular slider fit over the crank pin of the single throw 34-1.

After the mechanism is installed in the engine block, the crown 32-1 of the single action piston 32 is placed in the air cylinder located vertically on the upper side of the engine block; the crown 31-1 of the multi-row dynamic balance slider 31 is placed in the runway horizontally located in the engine block and the axis of the air cylinder and the axis of the runway are vertical to each other and in the same plan and their intersection point is just located on the rotation axis of the crankshaft 4. The above mentioned placement enables the center axis of the two reciprocating motion elements are not spaced away on the rotation axis of the crankshaft so that the whole mechanism possess an optimum dynamic balance effect. If the equal mass of the multi-row dynamic balance slider 31 and the single action piston 32 are ensured, and the weight center lies in respective axis, then an optimum dynamic balance effect can be obtained and the bending moment on the axis of the crankshaft in theory disappear.

Utilization of the structure in the internal combustion engine will result in an embodiment of the internal combustion engine using the crank circular slider mechanism and the utilization of the structure in the compressor will result in compressor using the crank circular slider mechanism.

The fourth embodiment of the invention provides a T type crank circular slider mechanism formed by combination of the double action one row piston and a single action multi-row piston.

Figure 13:
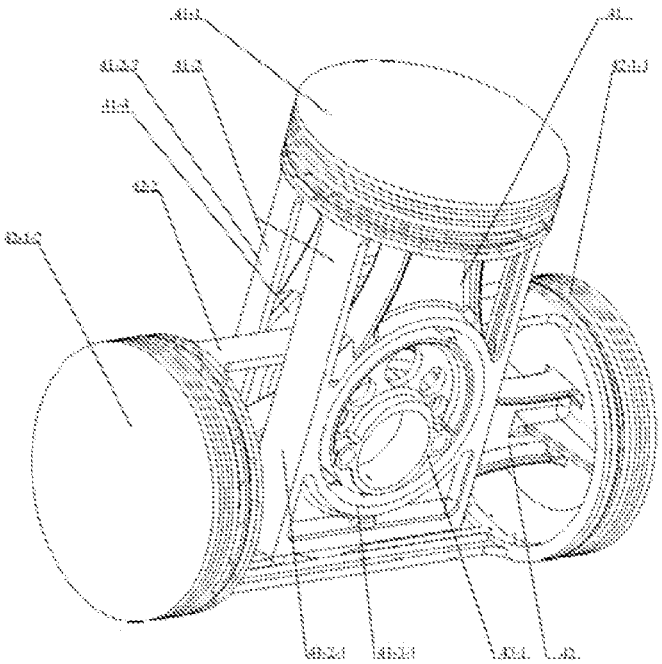
FIG. 13 is a perspective ong the T type crank circular slider mechanism proposed in the fourth embodiment of the invention.
Figure 14:
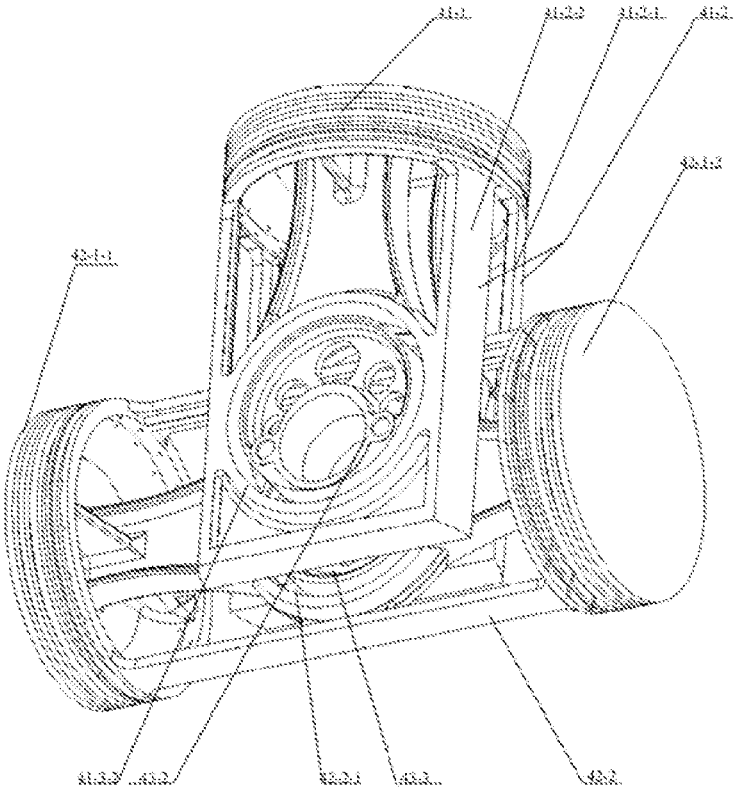
FIG. 14 is another perspective of the T type crank circular slider mechanism proposed in the fourth embodiment of the invention, the angle of view thereof is same as the FIG. 13.
Figure 15:
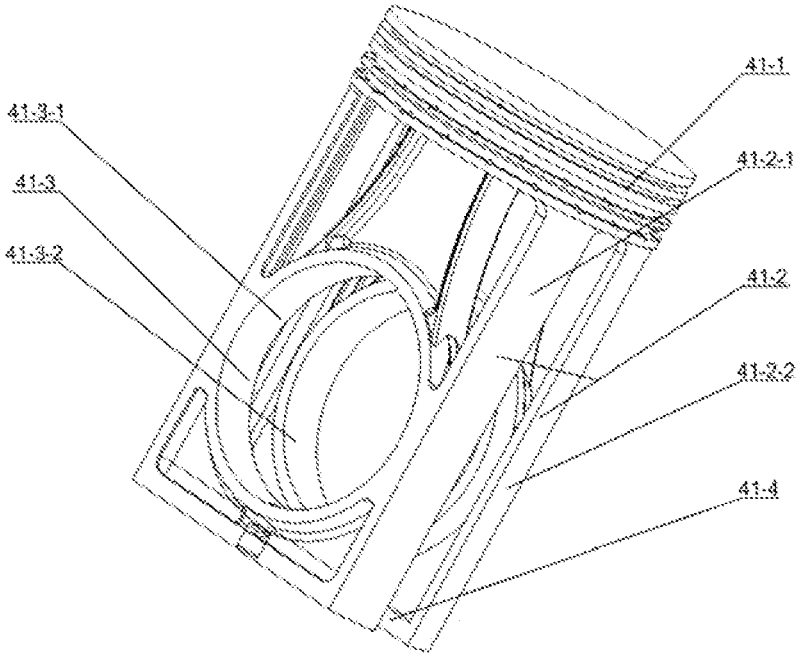
FIG. 15 is a perspective of the multi-row one action piston.

Please see FIG. 13, which is a perspective of the T type crank circular slider mechanism provide by the embodiment of the invention. FIG. 14 is another perspective of the T type crank circular crank circular slider mechanism seen form the opposite view to the FIG. 13. The figures do not show the crankshaft with a crank pin penetrating the eccentric hole of the circular slider, because the part is the same as the dual circular slider mechanism and multi-circular-slider mechanism mentioned in background. For underlining the feature of the invention they are omitted. FIG. 15 is the perspective of the single crown multi-row piston. As seen in the figures, the T type crank circular slider mechanism comprises two reciprocating motion elements, respectively referred to as multi-row single action piston 41 and double action piston 42, which respectively are placed on the reciprocating rails vertical to each other. The multi-row single action piston 41 can move up and down in the vertical direction with its piston top side upward; the double action piston 42 can move right and left in the horizontal direction. From FIG. 13, the multi-row single action piston 41 has a guiding part 41-2 which is divided by a longitudinal groove 41-4 into two rows of parallel branches. The double action piston 42 has a guiding part 42-2 which penetrates the longitudinal groove 41-4 in its thickness direction so that the two reciprocating motion elements cross each other. From figures, the multi-row single action piston 41 has a longitudinal groove 41-4 which provides the double action piston 42 with a space where it can cross the multi-row single action piston 41 so that the centre lines of the two reciprocating motion elements can be crossed vertically in a plan, which is the main feature of the T type crank circular slider mechanism. The following gives the particular structure of the T type crank circular slider mechanism.

The multi-row single action piston 41 uses a structure of guiding part with branches as detailed shown in FIGS. 13 and 15. The multi-row single action piston 41 is multi-row single action piston with a crown 41-1, whose guiding part 41-2 is divided by a longitudinal groove 41-4 whose opening begins in the bottom side of the guiding part into two rows of parallel branches, respectively referred to as the first row of guiding part 41-2-1 and the second row of guiding part 41-2-2; the first row of guiding part 41-2-1 and the second row of guiding part 41-2-2 have the same structures, especially the same thickness and the same circular slider receiving hole placed in the same position. As illustrated in figures, the first row of guiding part 41-2-1 is provided with the first circular slider receiving hole 41-3-1 for receiving the first circular slider 43-1 and the second row of guiding part is provided with the second circular slider receiving hole for receiving the second circular slider 43-2. The sliders are the same ones.

As illustrated in FIG. 13, the double action piston 42 has a first crown 42-1-1, a second crown 42-1-2 and a guiding part 42-2 which connects the crowns. The first crown 42-1-1 and the second crown 42-1-2 are same as the conventional one. When being used in the internal combustion engine they are used as bottom side of the combustion chamber; when being used in the compressor, they are the working face of the piston. Their structures are same as respective position of the double action piston of the other crank circular slider mechanism and hence are not described herein. The guiding part 42-2 is a cuboid in its outer profile and is provided with middle circular slider receiving hole in the middle position. The double action piston has a guiding part 42-2 whose thickness is defined based on the width of the longitudinal groove 41-4 of the multi-row single action piston 41 so that the it can be inserted into the longitudinal groove 41-4 in the thickness direction so that the multi-row single action piston 41 and the double action piston 42 can be crossed in their guiding parts. The thickness of the guiding part refers to the size in the dimension of the guiding part along the axis of the circular slider receiving hole; the width of the guiding part refers to the size in the dimension of the guiding part both vertical to the guiding part circular slider receiving hole and vertical to the axis of the piston.

The multi-row single action piston 41 has a longitudinal groove 41-4 with a depth enough for the multi-row single action piston 41 to be reciprocated without intrusion of the double action piston 42. The depth is defined based on the distance relationship of the spacial arrangement of the two reciprocating motion elements. In the circumstance of being most compact, it is expected that when the multi-row single action piston 41 moves to the lower stopping point, the lower end face of the guiding part 41-2 is in flush with the rail surface located in the lower part of the guiding part 42-2 of the double action piton, the depth of the longitudinal groove 41-4 is no less than the sum of width of the guiding part 42-2 of the double action piston 42 and the stroke of the multi-row single action piston.

As seen in FIG. 14, the multi-row single action 41 has a first circular slider receiving hole 41-3-1 for receiving the first circular slider 43-1 and a second circular slider receiving hole 41-3-2 for receiving the second circular slider 43-2. They are arranged in the same phase. The double action piston 42 is provided with middle circular slider 43-3 which is in the opposite phase to the two circular sliders, that is in a phase difference of 180 degree. The three circular sliders have eccentric holes fitting over the same and one crank pin of the crankshaft, the adjacent circular sliders are secured to each other by location pins or the like. The three circular sliders are fit to each other so that the space can be save as more as possible and the size of the whole structure is reduced. For the optimum balance effect, the thickness of each of the first circular slider 43-1 and the second circular slider 43-2 is half of the thickness of the middle circular slider 43-3 and total mass of the first circular slider 43-1 and the second circular slider 43-2 is equal to the mass of the middle circular slider 43-3.

After the mechanism is installed in the engine block, the two crowns of the double action piston 42 are respectively installed in a pair of horizontal air cylinder arranged face to face in the engine block. The two horizontal air cylinders are coaxial. The common axis of the two horizontal air cylinders is the axis of the reciprocating rails of the double action piston 42; the crown 41-1 of the multi-row single action piston 41 is placed in the vertical air cylinder which is vertically placed in the middle of the two horizontal air cylinders with its axis vertical to and coplanar with the common axis of the two horizontal air cylinders and being the axis of the reciprocating rail of the multi-row single action piston 41. By the above arrangement, the multi-row single action piston 41 and double action piston 42 have a coplanar and vertical axis of the reciprocating rails and the crossing point is on the rotation axis of the crankshaft. Since no distance exists on the axis of the crankshaft between the axis of the reciprocating rails o the two reciprocating motion elements and no bending moment exists on the axis of the crankshaft, the whole mechanism possesses an optimum dynamic balance effect. for the optimum dynamic balance effect, it is required that the multi-row single action piston 41 and the double action piston 42 have completely same mass and their weight center lies in the respective axis.

The utilization of the crank circular slider mechanism in the internal combustion engine will result in an embodiment of the internal combustion engine using the crank circular slider mechanism, the utilization of the crank circular slider mechanism in the compressor will result in the embodiment of the compressor using the crank circular slider mechanism.

The above mentioned embodiments offer multi-row reciprocating motion element. For example, the second embodiment of piston in FIG. 8, the fourth embodiment of piston in FIG. 15; the first embodiment of the multi-row dynamic balance slider in FIG. 4; the third embodiment of multi-row dynamic slider in FIG. 12; all those are multi-row reciprocating motion elements and hence no embodiment of the multi-row piston is cited solely.

The said embodiments all should be placed in the respective engine block so that it gets the support for the motion. The engine block should be adapted to the structure of the combination of the multi-row reciprocating motion elements and one row reciprocating motion elements. The fifth embodiment of the invention offers an engine block for the crank circular slider mechanism.

Figure 16:
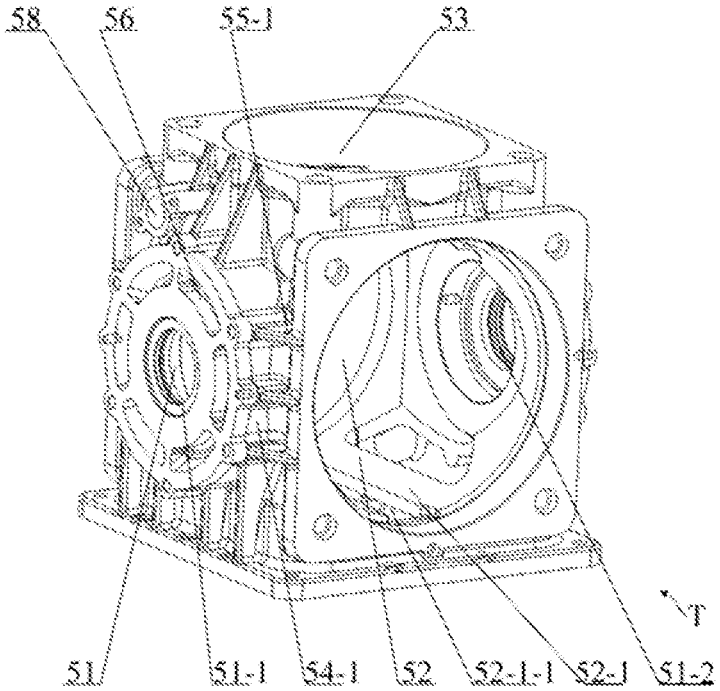
FIG. 16 is one of the perspectives of the body of the engine block proposed in the fifth embodiment of the invention.
Figure 17:
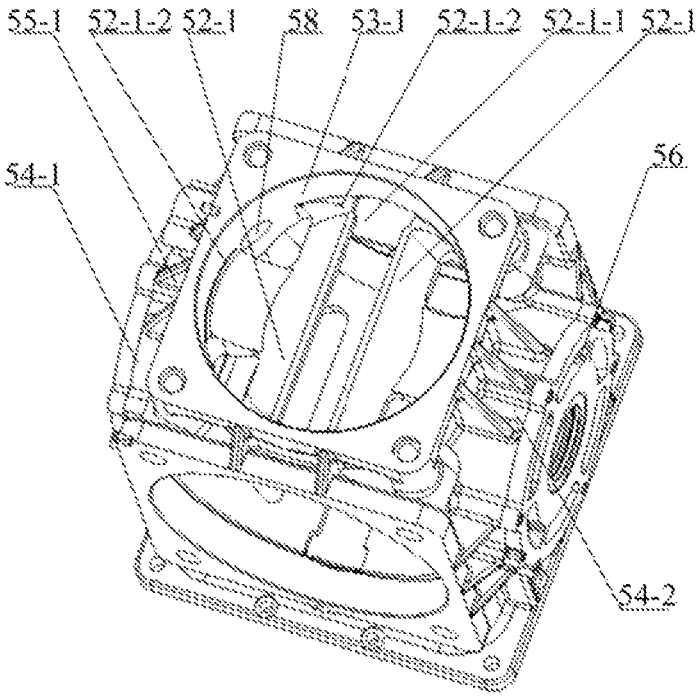
FIG. 17 is the second one of the perspectives of the body of the engine block proposed in the fifth embodiment.

Please refer to FIGS. 16 and 17 which are different perspectives in two different view of the body T of the engine block provided in the embodiment of the invention. Please refer to FIG. 18 which is a perspective of a one row runway used for the engine block; please refer to FIGS. 19 and 20 which is a perspective in different views showing the complete engine block after the one row runway is installed in the body T.

As illustrated in FIGS. 16 and 17, the body T of the engine block is a cuboid and is provided with three passages with three center axis vertically crossed in one point, respectively referred to as crankshaft penetrating hole 51, horizontal passage 52 and vertical passage 53. In the embodiment, the horizontal passage 52 is used for placing multi-row runway for providing the multi-row reciprocating motion elements with the reciprocating rails and also is referred to as multi-row reciprocating motion element, the vertical runway 53 is used for placing a one row runway providing the one row reciprocating motion elements with the reciprocating rails and is also referred to as one row reciprocating passage.

The crankshaft penetration hole 51 is use for penetrating the crankshaft. The direction of its penetrating the body T of the engine block is referred to as front to back direction. The crankshaft penetration hole 51 is provided with front main bearing hole 51-1 and back main bearing hole 51-2 on both ends and position where it joins the front and back sides of the body T of the engine block. The front main bearing hole 51-1 is provided with a front boss which projects the frond end face of the convex body T of the engine block and penetrates the front main bearing hole 51-1. The front boss 54-1 is used for extending the support length of the main bearing hole 51-1. The front boss 54-1 is provided on the outer side with several ribs connecting the lateral sides of the front boss 54-1 to the front end face of the body T of the engine block so as to enforce the strength at this position. Similarly, the back main bearing hole 51-2 is also provided with a back boss projecting the back end face of the body T of the engine block and penetrating the back main bearing hole 54-2, the back boss is used for extending the support length of the back main bearing hole. The back boss 54-2 is provided on the outer side with several ribs connecting the outer side of the back boss 54-2 to the back end face of the body T of the engine block so as to enforce the strength at that position. The back and front bosses are also provided with several annular weight reduction holes 56.

The horizontal passages 52 is used for providing horizontally arranged reciprocating motion elements with rail space of the reciprocation. The horizontal passage 52 has a extension direction which is left and right direction of the body T of the engine block. As illustrated in figures, the horizontal passage 52 is provided with a horizontal runway 52-1 integral with the body T of the engine block. The horizontal runway 52-1 is a thin strip arranged in the radial surface of the horizontal passage 52 and with an extension direction consistent with the horizontal passage 52 which is arranged symmetrically on the upper side and lower side and comprised two row on each side between which a space 52-1-1 exists. The space 52-1-1 respectively is placed in the highest end and lowest end. The horizontal runway 52-1 situated on the lower part is provided on the top side with positioning face 52-1-2 for positioning the vertical runway 57.

The vertical passage 53 is illustrated in FIGS. 16 and 17 for providing vertically arranged reciprocating motion elements with rail space of the vertical motion. Its axis extends in the upper and lower direction of the engine block and crosses the axis of the crankshaft penetration hole 51, horizontal passage 52 vertically at one point. As seen in FIGS. 16 and 17, the vertical passage 53 the body T of the engine block is not provided with runway.

Figure 18:
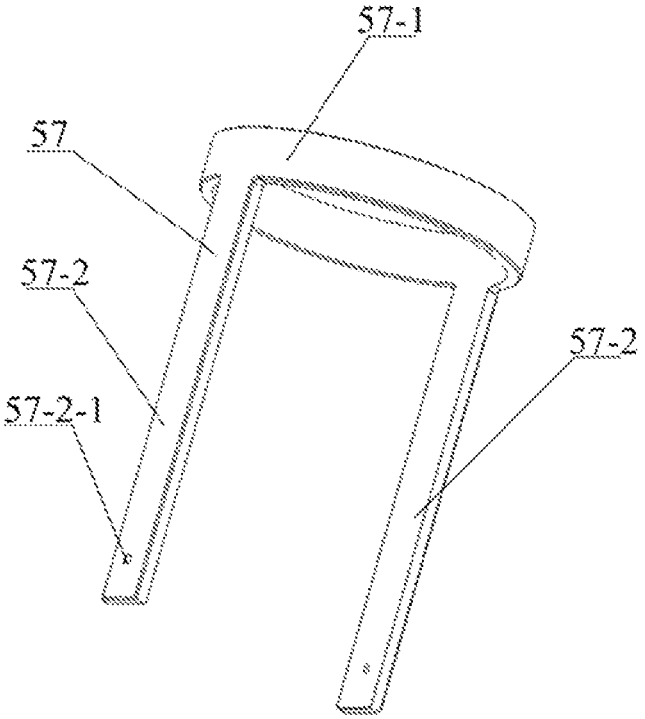
FIG. 18 is perspective of the one-row runway solely prepared proposed in the fifth embodiment.

Please refer to FIG. 18 which shows the vertical runway 57 which is a solely produced element and comprises upper position ring 57-1, rail strip 57-2. The upper position ring 57-1 is a ring arranged on the upper side of the vertical runway 57. The rail strip 57-2 is a pair of elongate strip-like narrow rails oppositely arranged hanging from the upper position ring 57-1, its inner surface is runway surface of the one row runway. The rail strip 57-2 has a width suitable to penetrate the space 52-1-1 of the horizontal runway 52-1. As illustrated in figures, the vertical runway 57 has rail strips 57-2 under which a screw hole 57-2-1 is provided. The vertical runway 57 provides a one row reciprocating motion element with a pair of runways, also referred to as one row runways.

Figure 19:
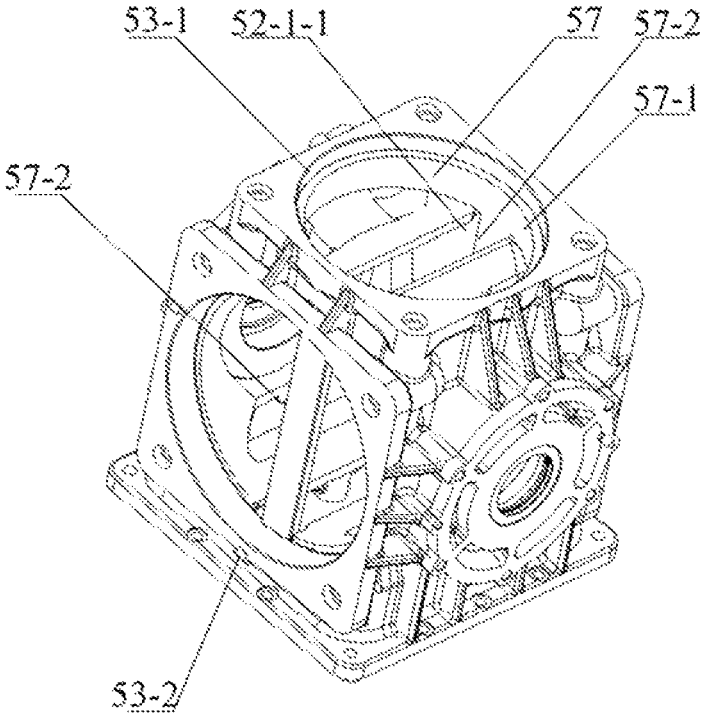
FIG. 19 is one of the perspectives of the engine block of the fifth embodiment already mounting the one row runway.

Please refer to FIG. 17, the vertical passage 53 is provided on the upper opening with a round hole whose inner diameter engages the outer diameter of the upper position ring 57-1. In the bottom inner edge of the round hole 53-1 are provided a position surface 52-1-2 on the top of the horizontal runway 52-1 and other specific position surface 52-1-2. The position surface 52-1-2 and the round face 53-1 generally are referred to as the first positioning structure which can secure the solely produced vertical runway 57 in the vertical passage 53. Please refer to FIG. 19 showing the complete machine after installing the vertical runway 57 in the body of the engine block, as illustrated in the figure the rail strip 57-2 of the vertical runway 57 is inserted through the space 52-1-1 situated in the horizontal runway while the upper location ring 57-1 of the vertical runway 57 is located in the round hole 53-1 in the position of the opening of the vertical passage 53 and the bottom end face is supported by the positioning face 52-1-2. The rail strip 57-2 has a screw hole 57-2-1 on its lower side, corresponding to the screw hole 53-2 situated on the lower side of the vertical passage 53 and which through the screws can secure the underside of the rail strip 57-2 to the inner wall surface of the vertical runway 53.

Figure 20:
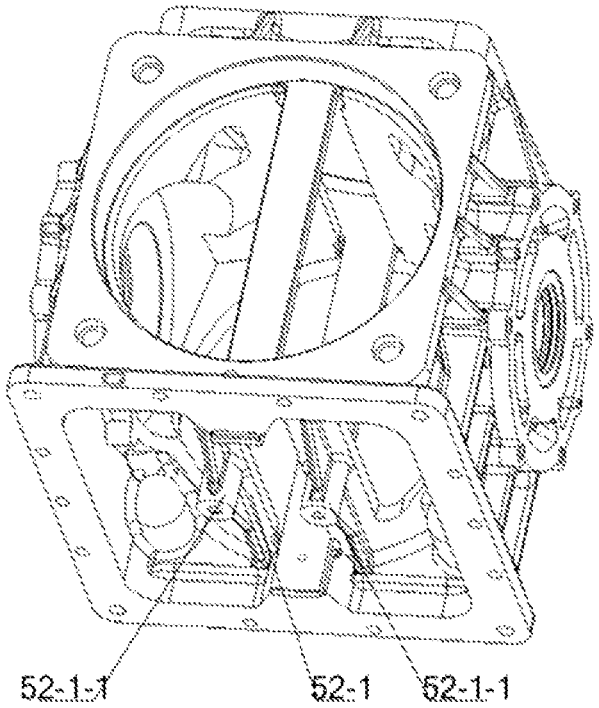
FIG. 20 is a second one of the perspectives of the engine block of the fifth embodiment already mounting the one row runway, in this view the bottom side of the engine block can be seen.

Please refer to FIG. 20 which shows the bottom side of the body T of the engine body. An oil pump structure is provided in lower side of the horizontal runway 52-1 where the body T of the engine block is situated in the lower side; that is to say, a pair of inner screw boss 52-1-1 respectively arranged on the two rows of horizontal runway 52-1, through the inner screw boss 52-1-1, can receive the solely produced oil pump.

Please refer to FIG. 16 and FIG. 17, which shows a connection hole 58 for breath pipe bend is provided on the body T of the engine block, the connection hole 58 is provided on the wall surface of the body T of the engine block and communicates the inner chamber of the engine block and outer atmosphere. The position is used for the arranging the breath pipe bend by which the inner chamber of the engine block communicates the outer atmosphere to avoid the pressure in the inner chamber from being too high so as to negatively influence the normal working of the whole machine.

The oil pump installation structure and the connection hole 58 of breath pipe bend can be integrated into the engine block as an accessory structure so as to effectively improve the specific quality and specific volume.

The engine block cooperates with the embodiments and can be the engine block of the three-circular-slider structure formed by the combination of multi-row reciprocating motion element and one row reciprocating motion element. Depending on the various combinations of the multi-row reciprocating motion elements and one-row reciprocating motion elements, the position of the multi-row runway and one row runway in the engine block can be exchanged, that is to say, the multi-row runway is arranged in the vertical direction and the one row runway in the horizontal direction. Moreover, the multi-row runway can produced solely and the one row runway integral with the body of the engine block.

The sixth embodiment is a crank circular slider mechanism formed by the combination of a double action multi-row piston and a single action one row piston.

Figure 21:
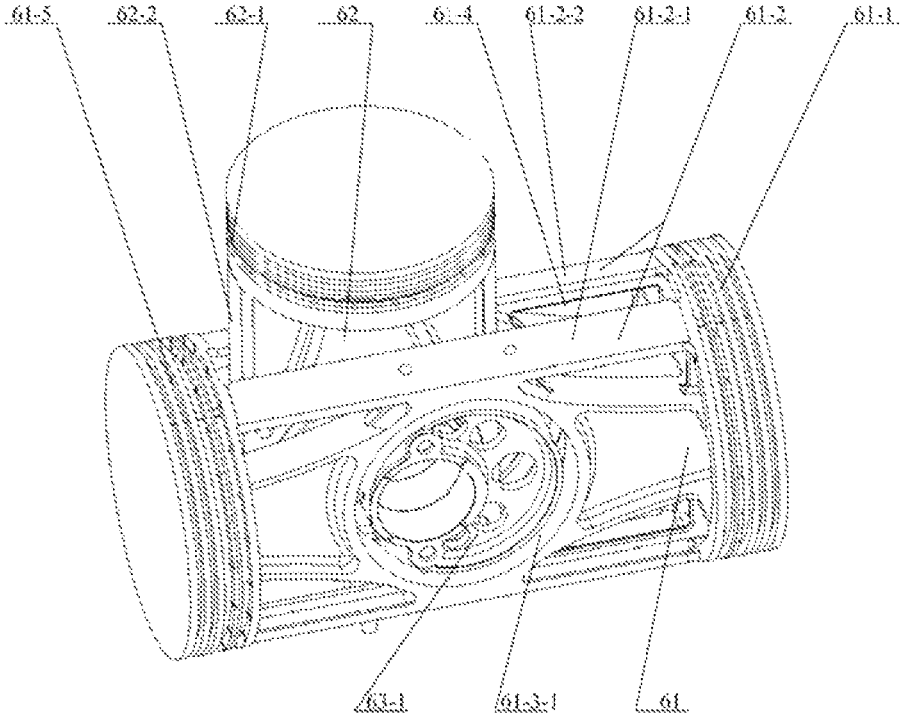
FIG. 21 is a perspective of the crank circular slider mechanism proposed in the sixth embodiment of the invention.

Please refer to FIG. 21 which is a perspective of the crank circular slider mechanism. Please refer to FIG. 22, which shows another perspective of the crank circular slider mechanism. The figures does not show the crankshaft with crank pin penetrating the eccentric hole of the circular slider because the double circular slider mechanism, the multi circular slider mechanism mentioned in the part and background are the same, and hence for underlining the features of the invention, is omitted.

Figure 22:
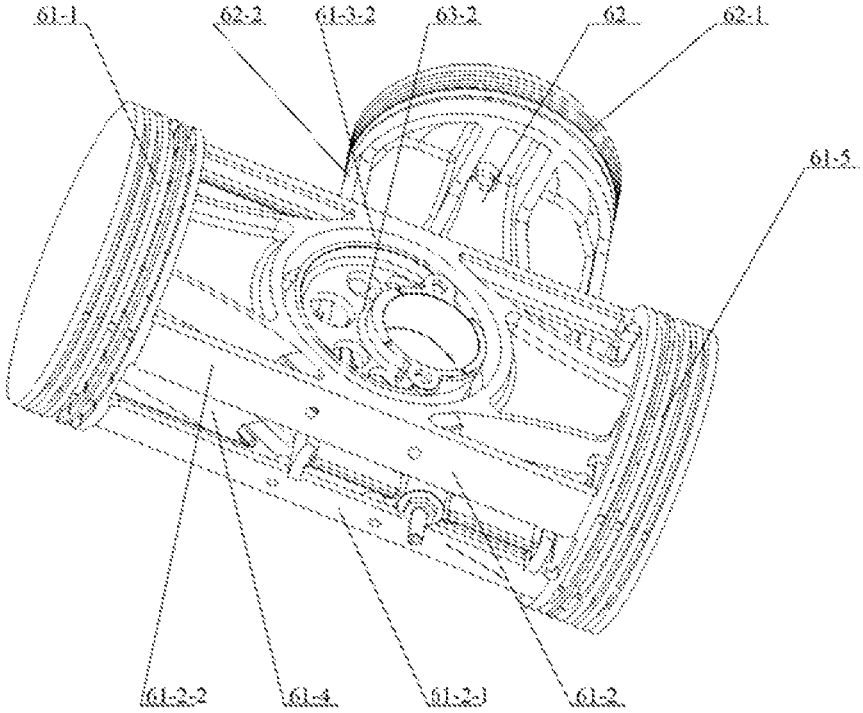
FIG. 22 is a perspective of another side of the crank circular slider mechanism proposed in the sixth embodiment of the invention.

As illustrated in figures, the crank circular slider mechanism comprises two reciprocating motion elements, respectively multi-row double action piston 61 and one row single action piston 62, both are respectively arranged on the reciprocating rails vertical to each other. The multi-row double action piston 62 is arranged in vertical direction with topside upward. As seen in FIG. 21 and FIG. 22, the guiding part 61-2 of the multi-row double action piston 61 is divided by a longitudinal groove 61-4 into two rows of parallel branches and the guiding part 62-2 of the one row single action piston 62 can penetrate the longitudinal groove 61-4 in the thickness direction so that the two reciprocating motion elements can cross each other. As seen in figures, the multi-row double action piston 61 has a longitudinal 61-4 which provides the one row single action piston 62 with a space where it crosses the multi-row double action piston 61 so that the reciprocating center lines of the two reciprocating motion elements can be vertically crossed in a plan, which is the main feature of the crank circular slider mechanism. The following gives the detailed description of the structure of the crank circular slider mechanism.

The multi-row double action piston 61 uses guiding part structure with branches which can be seen in FIGS. 21 and 22 showing the piston. The multi-row double action piston 61 is a multi-row double action piston with a first crown 61-1 and a second crown 61-5, the guiding part 61-2 is divided by a longitudinal groove 61-4 into two rows of parallel branches, respectively, the first row of guiding part 61-2-1 and the second row of guiding part 61-2-2 both of which have the same structures, especially the same thickness and same circular slider receiving hole on the same position. As illustrated in figures the first row of guiding part 61-2-1 is provided with a first circular slider receiving hole 61-3-1, the second row of guiding part is provided with a second circular slider receiving hole 61-3-2, respectively receiving the first circular slider 63-1 and the second circular slider 63-2. The two sliders are same.

As illustrated in FIGS. 21 and 22, the one row single action piston 62 has a crown 62-1 and a guiding part 62-2. The crown 62-1 has the same structure as the convention piston, which when used in the internal combustion engine is used as the bottom side of the combustion chamber and when used in the compressor is used as a working surface of the piston. The structure is substantially same as respective part of the single action piston of other crank circular slider mechanism and hence is not described more. The guiding part 62-2 is a cuboid in the outer profile, and is provided in the middle with a middle circular slider receiving hole (not seen in figures). The one row single action piston has a guiding part 62-2 whose thickness is defined based on the width of the longitudinal groove 61-4 of the multi-row double action piston 61 so that it can be inserted into the longitudinal groove 61-4 in the thickness direction so that the multi-row double action piston 61 and the one row single action piston 62 can be crossed at the guiding parts thereof. The thickness of the guiding part, is referred to as the size of the dimension of the guiding part in the axis of the circular slider receiving hole.

The longitudinal groove 61-4 of the multi-row double action piston 61 requires such a length that during it reciprocates the multi-row double action piston 61 can reciprocates without intrusion of the one row single action piston 62. The length is defined based on the distance relationship of the spacial arrangement of the two reciprocating motion elements. Under the compactness, it is expected that the multi-row double action piston 61 moves to the left and right stopping point while two ends of the guiding part 61-2, that is, the inner sides of the first crown 61-1 and the second crown 61-5 approaches but not comes into contact with the rail adjacent the side of the guiding part 62-2 of the one row single action piston 62 therefore the length of the longitudinal groove 61-4 is no less than the total of the width of the guiding part 62-2 of the one row single action piston 62 and the stroke of the multi-row double action piston 61.

The first circular slider receiving hole 61-3-1 of the multi-row double action piston 61 is provided with the first circular slider 63-1, the second circular slider receiving hole 61-3-2 is provided with the second circular slider 63-2, both of them are arranged in the same phase. The double action piston 62 is provided with a middle circular slider (not seen in figure) which is arranged opposite phase to the two circular sliders, that is, a difference phase of 180 degree. The three circular sliders have the eccentric holes which fit over the common crank pin of the crankshaft while the adjacent circular sliders are secured by location pins or the like. The three circular sliders fit each other so that the space can be saved am more as possible and the size of the whole structure is reduced. For the optimum balance effect the first circular slider 63-1 and the second circular slider 63-2 have thickness which is equal to the half of the thickness of the middle circular slider and the total mass of the first circular slider 63-1 and the second circular slider 63-2 is equal to the mass of the middle circular slider.

The utilization of the said structure in the internal combustion engine will result in the embodiment of the internal combustion engine using the crank circular slider mechanism; the utilization of the said structure in the compressor will result in the embodiment of the compressor using the crank circular slider mechanism.

The engine block of the fifth embodiment can used as the engine block of the crank circular slider mechanism.

The above mentioned is only the preferred embodiments of the present invention, it should be noted that the skilled in the art can also make many improvements and modifications without departure from the basic theory of the present invention, these improvements and modifications will be also be considered as the protections scope of the invention

The invention claimed is:

1. An engine block comprising:

a passage for a multi-row reciprocating motion part;

a passage for a one-row reciprocating motion part, central axes of said passages being vertical to and across each other at one point; and a crankshaft penetration hole traversing a body of the engine block from a front to a back so as to facilitate penetration of a crankshaft wherein the passages for the multi-row reciprocating motion part and the one-row reciprocating motion part are respectively used for supplying a track space for reciprocating motion of the multi-row reciprocating motion part and a track space for reciprocating motion of the one-row reciprocating motion part;

wherein the passage for the multi-row reciprocating motion part comprises multi-row runways comprising two rows of runways separated by a separation groove, each of the two rows of runways comprising a pair of guide rails facing each other, inner circumferential surfaces of the guide rails respectively engaging with guiding surfaces on sides of the first row of the first guiding part and the second row of the first guiding part of the multi-row reciprocating motion part such that each row of runway forms a reciprocating motion track;

wherein the passage for the one-row reciprocating motion part comprises a one-row runway comprising a position ring and a pair of guide rails which extend from the bottom face of the position ring, the pair of guide rails are positioned through the separation groove, wherein the passage for the one-row reciprocating motion part forms an opening in the engine block, and the opening includes positioning structures which cooperate with the position ring to locate and secure the one-row runway; and wherein the multi-row runways and the one-row runway are vertical to each other.

2. A crank circular slider mechanism for the engine block of claim 1, the crank circular slider mechanism comprising:

(A) the multi-row reciprocating motion part comprising a mass and further comprising:

a first guiding part which is divided by a longitudinal groove into two rows parallel to each other, the two rows comprising:

a first row comprising a first hole receiving a first circular slider; and a second row comprising a second hole receiving a second circular slider; and (B) the one-row reciprocating motion part comprising a mass and a second guiding part which is configured to be inserted into the longitudinal groove of the multi-row reciprocating motion part along the thickness direction so as to vertically traverse the multi-row reciprocating motion part, the second guiding part comprising a hole receiving a middle circular slider;

wherein the first circular slider and the second circular slider are mounted in the same phase, the middle circular slider is sandwiched between the first circular slider and the second circular slider and is located with a 180 degree phase difference compared to the first and second circular sliders, and adjacent circular sliders are secured to each other; and wherein a circular slider group corresponding to the first circular slider, the second circular slider, and the middle circular slider has a mass center which lies on an axial line of a crank pin of the crankshaft, and the axial line of the crank pin is different from a rotation axial line of the crankshaft.

3. The crank circular slider mechanism of claim 2, wherein the multi-row reciprocating motion part is a dynamic balance slider and the one-row reciprocating motion part is a double-action piston.

4. The crank circular slider mechanism of claim 2, wherein each of the multi-row reciprocating motion part and the one-row reciprocating motion part is a piston, respectively a multi-row reciprocating piston and a one-row piston, and the pistons are single-action pistons.

5. The crank circular slider mechanism of claim 2, wherein the multi-row reciprocating motion part is a dynamic balance slider and the one-row reciprocating motion part is a single-action piston.

6. The crank circular slider mechanism of claim 2, wherein the multi-row reciprocating motion part is a single-action piston and the one-row reciprocating motion part is a double-action piston.

7. The crank circular slider mechanism of claim 2, wherein the multi-row reciprocating motion part is a double-action piston and the one-row reciprocating motion part is a single-action piston.

8. The crank circular slider mechanism of claim 2, wherein a center line of a reciprocating motion track of the multi-row reciprocating motion part is vertical to and coplanar with a center line of a reciprocating motion track of the one-row reciprocating motion part, wherein said center lines cross at a point which lies in a rotating axis of the crankshaft of the crank circular slider mechanism.

9. The crank circular slider mechanism of claim 2, wherein the multi-row reciprocating motion part has a longitudinal groove whose length is no less than a sum of a width of the second guiding part of the one-row reciprocating motion part and a course of reciprocating motion of the multi-row reciprocating motion part.

10. The crank circular slider mechanism of claim 2, wherein mass centers of the multi-row reciprocating motion part and the one-row reciprocating motion part respectively are on their respective axes.

11. A multi-row reciprocating motion part for the crank circular slider mechanism of claim 2, further comprising:

a crown part;

wherein the first row of the first guiding part and the second row of the first guiding part along their thickness direction respectively are provided with through holes penetrating the first guiding part; and wherein the first row of the first guiding part and the second row of the first guiding part are respectively provided on both sides with a guiding surface whose lateral edge cooperates with an inner circumferential surface on a runway of the multi-row runways in which is located the multi-row reciprocating motion part, the multi-row reciprocating motion part being a piston or a dynamic balance slider.

12. The multi-row reciprocating motion part for the crank circular slider mechanism of claim 11, wherein the multi-row reciprocating motion part is a double-action piston with a crown part on each end or a dynamic balance slider with a crown part on each end.

13. The multi-row reciprocating motion part for the crank circular slider mechanism of claim 11, wherein the multi-row reciprocating motion part is a single-action reciprocating motion part with a crown part on only one end, wherein the longitudinal groove opens into a bottom surface of the first guiding part facing the crown part.

14. An internal combustion engine, comprising the crank circular slider mechanism of claim 2; wherein the internal combustion engine utilizes a working fluid that is a combustible, compressible fluid.

15. A compressor, comprising the crank circular slider mechanism of claim 2; wherein the compressor utilizes a working fluid that is a non-combustible, or inert, compressible fluid.

* * * * *